US005558324A

United States Patent [19]

Jourdan

[11] Patent Number: 5,558,324

[45] Date of Patent: Sep. 24, 1996

[54] BALL DELIVERY DEVICE

[76] Inventor: Larry Jourdan, Rte. 1, Box 8, Brooksville, Miss. 39739

[21] Appl. No.: 154,910

[22] Filed: Jul. 1, 1993

Related U.S. Application Data

[63] Continuation-in-part of Ser. No. 819,063, Jan. 10, 1992, abandoned.

[51] Int. Cl.[6] ..... A63B 69/00

[52] U.S. Cl. ..... 273/260

[58] Field of Search ..... 273/26 R, 26 A, 273/26 D, 29 R, 29 A, 201; 124/55, 56, 47, 49, 81, 83; 15/4; 473/76

[56] References Cited

U.S. PATENT DOCUMENTS

| | | | |
|---|---|---|---|
| 2,955,823 | 10/1960 | Chanko | 273/26 D |
| 2,955,824 | 10/1960 | Chanko . | |
| 3,633,250 | 1/1972 | Romney | 403/76 |
| 3,677,544 | 7/1972 | Meyers . | |
| 3,838,676 | 10/1974 | Kahelin . | |
| 3,999,753 | 12/1976 | Desilets et al. . | |
| 4,021,036 | 5/1977 | Nelson et al. . | |
| 4,021,037 | 5/1977 | Torbet . | |
| 4,132,214 | 1/1979 | Schnurr | 273/29 A |
| 4,194,648 | 3/1980 | Stanton | 273/201 |
| 4,345,578 | 8/1982 | Speer | 124/56 |
| 4,538,810 | 9/1985 | Brophy | 273/26 D |
| 4,548,407 | 10/1985 | Sato . | |
| 4,575,080 | 3/1986 | Miles | 273/29 A |
| 4,676,504 | 6/1987 | Ponza . | |
| 4,720,883 | 1/1988 | Sanchez . | |
| 4,830,372 | 5/1989 | Outlaw et al. . | |
| 4,955,606 | 9/1990 | Leps . | |
| 5,042,802 | 8/1991 | Depianta | 273/26 D |
| 5,066,010 | 11/1991 | Pingston | 273/26 D |
| 5,087,039 | 2/1992 | Laseke . | |
| 5,097,985 | 3/1992 | Jones | 273/26 D |
| 5,107,820 | 4/1992 | Salansky . | |
| 5,232,218 | 8/1993 | Leps | 273/26 D |
| 5,292,119 | 3/1994 | Norcross | 273/26 D |

FOREIGN PATENT DOCUMENTS

| | | |
|---|---|---|
| 256134A | 7/1984 | France . |
| 3339622 | 6/1984 | Germany . |

*Primary Examiner*—Theatrice Brown
*Attorney, Agent, or Firm*—Sixbey, Friedman, Leedom & Ferguson, P.C.; Daniel W. Sixbey; Jeffrey L. Costellia

[57] ABSTRACT

The ball delivery device includes an enclosed non-transparent delivery conduit extending outwardly from a substantially vertical support structure. The enclosed non-transparent delivery conduit includes a ball receiving portion at one end and a ball discharging portion terminating at a discharge opening at an opposite end. The entire length of the ball delivery conduit including the ball discharge portion is enclosed and made from a non-transparent material to prevent the player from viewing the ball until it is discharged for the opening. The delivery conduit may be pivotally connected to the support structure so that an adjustable positioning rod positioned between the support structure and the conduit can be adjusted to vary the angular position of the conduit. Alternatively, the delivery conduit may be stationary with respect to the support structure at an angle just sufficient to cause the ball to travel therethrough by the force of gravity. The discharge portion may be formed from non-transparent rigid tubing rotatably connected to the delivery conduit to provide a simple and effective means for allowing the player to vary the speed and trajectory of each pitch or series of pitches.

5 Claims, 4 Drawing Sheets

BALL DELIVERY DEVICE

This application is a continuation-in-part of Ser. No. 07/819,063 filed on Jan. 10, 1992, now abandoned.

FIELD OF INVENTION

The present invention relates generally to ball delivery devices used to pitch or toss balls to a player of a particular sport. More specifically, the invention is directed to a simple, inexpensive ball delivery device which eliminates the player's ability to anticipate the delivery of the ball prior to discharge from the device, and provides a simple effective means for varying the speed and trajectory of the ball, thereby improving the batting or racket skills of the player.

BACKGROUND OF THE INVENTION

Baseball, softball and related sports are very popular, and may be enjoyed by players possessing even the most basic batting or racket skills. However, many players, from novices to professionals, desire to improve their batting skills through repetitive practice. These batting skills include eye/hand coordination, proper batting stance/posture, control of bat speed and proper arm extension and wrist action. As a result, numerous mechanical devices have been developed to assist these players in improving their batting skills. These mechanical devices include both manually and automatically operated machines used to either sequentially throw the ball to the batter, release the ball down an inclined ramp into the batter's "strike zone" for hitting, or release a ball down a chute towards an upwardly inclined extension.

For example, U.S. Pat. No. 2,955,823 to Chanko discloses a batting practice device using a guideway or runway to guide the ball from a magazine tube into a path simulating that of a pitched ball. The guideway is formed from a pair of parallel spaced wire portions which extend downwardly from the tube and then curve upwardly. However, in operation, the player or batter is able to view the ball from its position of rest inside the magazine tube and throughout its travel on the wire guideway before being launched into an unguided path. As a result, the batter can anticipate the discharge of the ball from the guideway, thereby making it extremely easy for the batter to prepare and execute a proper swing utilizing the appropriate batting skills. However, this practice method is not realistic since, in competition, a batter does not have the luxury of anticipating the ball by viewing the moving ball as it accelerates through a known path. As a result, this device fails to force the batter to combine his batting knowledge and skills into a swing made on a split second decision without unnecessary anticipation. Moreover, since the batter is permitted to view the ball throughout its delivery, the device fails to test or challenge and, thereby, improve the player's eye to hand coordination skill, bat speed and wrist action.

U.S. Pat. No. 4,955,606 to Leps discloses a ball pitching device using ramps to direct and launch a ball. However, the launch ramp is open so that the batter may view the ball as it rolls the length of the ramp, thereby allowing the batter to anticipate the launch or discharge of the ball.

Other attempts to test or challenge, and thereby improve a player's batting skills include machines which by various mechanical means hurl or propel a ball to the player at various intervals, velocities, angles and heights. By adjusting such delivery characteristics as speed and trajectory, the degree of difficulty of a particular pitch can be substantially modified as desired. Such machines, however, generally incorporate a combination of complex spring biased structural elements which become worn or broken. Preferably, a ball pitching device should provide a simple and effective means for allowing the player to vary the speed and trajectory of each pitch or series of pitches, while also preventing the player from anticipating when the ball will reach the player.

SUMMARY OF THE INVENTION

It is one object of this invention to provide an improved ball placement device for effectively delivering one or more balls to a player in such a manner as to improve the player's batting or racket skills.

Another object of the present invention is to provide a novel and improved ball delivery device which is simple in construction, lightweight, collapsible and relatively inexpensive, and therefore, readily available to, and usable by, many consumers or players.

Yet another object of the present invention is to provide a novel and improved ball delivery device having an enclosed, non-transparent delivery conduit for delivering one or more balls to a player. This enclosed non-transparent delivery conduit prevents the player from anticipating the discharge of the ball from the conduit, thereby forcing the player to fine tune such batting skills as eye to hand coordination.

A further object of the present invention is to provide a novel and improved ball delivery device which can be adjusted to different heights according to the size of the player.

Yet another object of the present invention is to provide a novel and improved ball delivery device which permits the speed and trajectory of the ball to be changed by a simple and easy adjustment to the device.

A still further object of the present invention is to provide a novel and improved ball delivery device having a ball discharge portion which is adjustable to change the speed and/or trajectory of the ball as it exits the discharge portion.

Yet another object of the present invention is to provide a novel and improved ball delivery device having an enclosed non-transparent delivery conduit which is adjustable to vary the speed of the ball as desired.

Another object of the present invention is to provide a novel and improved ball delivery device which prevents a player from anticipating the release of the ball from a non-transparent delivery conduit.

Yet another object of the present invention is to provide a novel and improved ball delivery device which projects the ball to a user in the direction of a thrown pitch.

These and other objects of the present invention are achieved by providing and enclosed non-transparent delivery conduit extending outwardly from a substantially vertical support structure. The enclosed non-transparent delivery conduit includes a ball receiving portion at one end and a ball discharging portion terminating at a discharge opening at an opposite end. The delivery conduit extends outwardly from the support structure at a sufficient angle to cause each ball positioned in the conduit to move by gravity toward the discharge opening. The entire length of the ball delivery conduit including the ball discharge portion is enclosed and made from a non-transparent material to prevent the player from viewing the ball until it is discharged from the discharge opening. The delivery conduit may be pivotally connected to the support structure so that an adjustable positioning rod positioned between the support structure and the conduit can be adjusted to vary the angular position of the conduit.

The discharge portion may be formed from non-transparent rigid tubing rotatably connected to the delivery conduit to provide a simple and effective means for allowing the player to vary the speed and trajectory of each pitch or series of pitches. In addition, the discharge portion is designed to be rotatably connected to the delivery conduit to permit rotation within a 180° range to direct the ball towards the user from the direction of the pitcher's mound. Alternatively, the discharge portion may be formed of a deformable material, such as corrugated metal or plastic, which can be adjusted to an infinite number or positions corresponding to various ball trajectories. The support structure may include two telescoping tubes movable relative to one another into a plurality of positions to change the height of the delivery conduit.

BEST MODE FOR CARRYING OUT THE INVENTION

Figure 1:
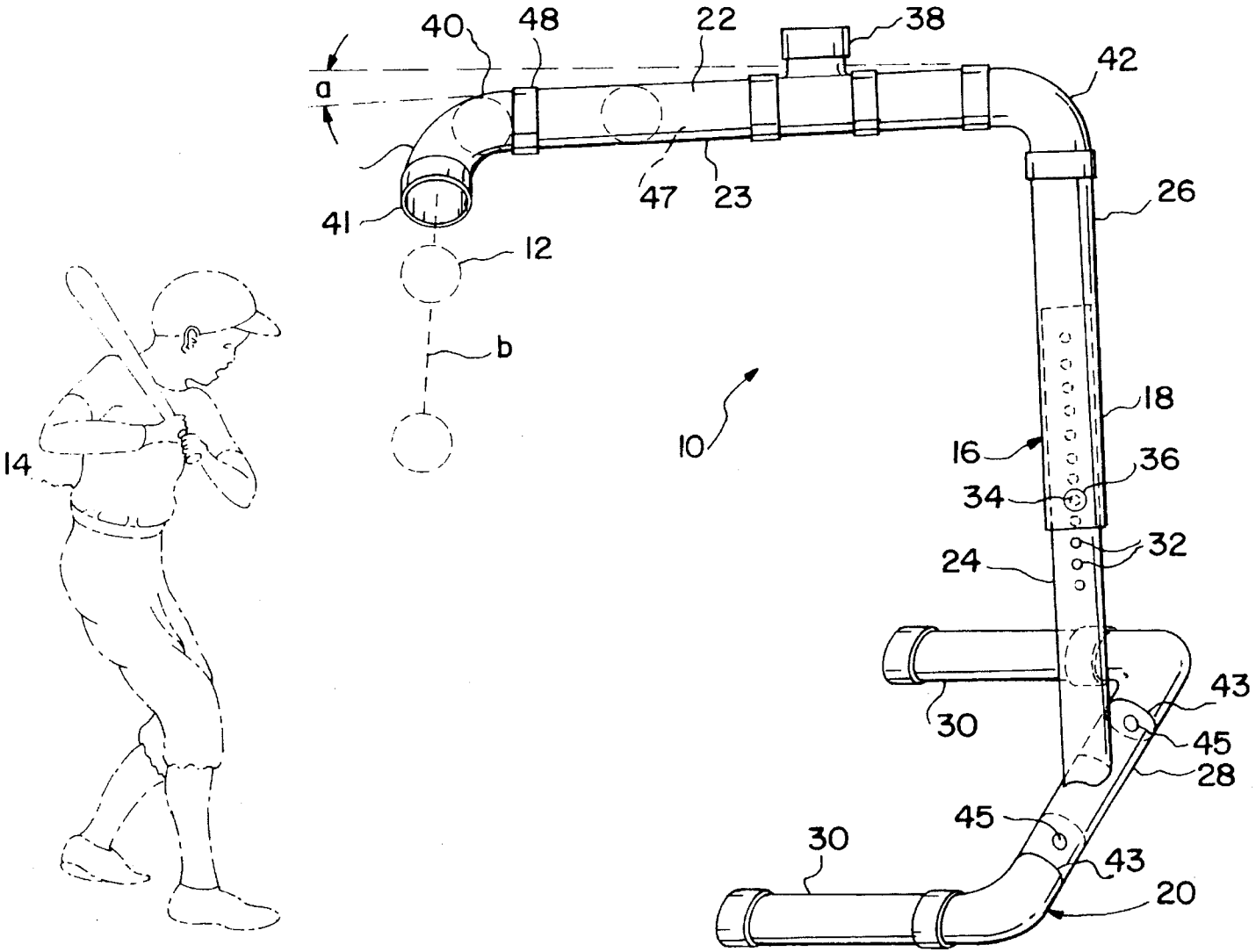
FIG. 1 is a perspective view of the ball delivery device of the present invention.

Referring to FIG. 1, the ball delivery device of the present invention indicated generally as 10 operates to deliver one or more balls 12 into an unguarded delivery path b in front of a player or batter 14. The ball delivery device of the present invention may be used to deliver different types of balls to the players of various sports such as baseball, softball, tennis, etc.

The ball delivery device 10 includes a support structure 16 having a substantially vertical column 18 extending from a base 20. An enclosed non-transparent delivery conduit 22 is connected to, and extends outwardly from, column 18.

Column 18 of support structure 16 includes a lower portion 24 telescopically engaged with an upper portion 26. One end of lower portion 24 is connected to transverse arm 28 of base 20 so that column 18 is supported in an upright position. Base 20 is generally U-shaped and includes transverse arm 28 extending across legs 30. The support structure 16 is shown in FIG. 1 as being formed from tubular members such as PVC or metal pipes joined together by threadable or adhesive type connections. However, base 20 of support structure 16 may be formed from a variety of materials into various shapes so long as the final base structure functions to support column 18 in an upright position. In addition, column 18 may be made from any elongated structures which are telescoping such that lower portion 24 can be inserted into upper portion 26 to provide a height adjusting mechanism. Holes 32 extend through the center axis and both walls of lower portion 24 along a portion of its length. Complementary hole 34 formed in upper portion 26 may be aligned with any one of the holes 32 in lower portion 24 to allow a spring mounted pin 36 to be inserted therethrough to secure portion 26 in position relative to portion 24.

The enclosed non-transparent delivery conduit 22 includes a ball discharge portion 40 formed on one end and a ball receiving portion 38 spaced from ball discharge portion 40 along the length of conduit 22. As shown in FIG. 1, conduit 22 is connected to upper portion 26 by angle joint 42 and extends outwardly from column 18 at a sufficient angle "a" to cause ball 12 to roll by gravity through delivery conduit 22 from ball receiving portion 38 to ball discharge portion 40. The angle of enclosed delivery conduit 22 is determined by the position in which lower portion 24 is connected to transverse arm 28. In this embodiment, therefore, the delivery angle "a" is determined by the initial construction of the ball delivery device 10. However, it should be understood that the angle of column 18 could be varied by transverse arm 28 by adjustable connections 43 which allow lower portion 24 to be rotated so as to change the delivery angle "a" of conduit 22. For example, transverse arm 28 may telescope at 43 with legs 30 and be rotatable relative thereto. Once an angle has been selected, transverse arm 28 is locked against rotation by tightening set screws 45 into engagement with legs 30 that extend into the ends of transverse arm 28.

Enclosed delivery conduit 22 is shown in FIG. 1 as a tubular structure similar to that of the support structure 16. However, the delivery conduit 22 may be formed from any elongated conduit which is completely enclosed along its effective length, and must also be formed of a non-transparent material, such as any opaque, colored or coated piping or tubing. By providing a delivery conduit which is both enclosed and non-transparent, a player is prevented from viewing the ball as it passes through the delivery conduit, and in this manner, the player is unable to anticipate the discharge of the ball from the delivery conduit.

Figure 3:
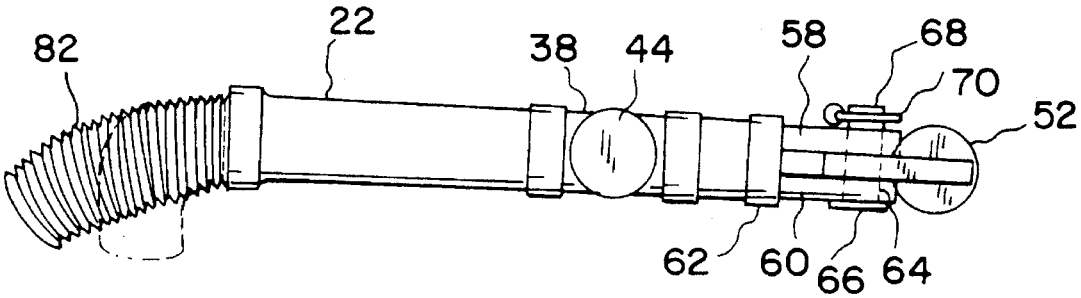
FIG. 3 is a plan view of the ball delivery device of FIG. 2.

As with support structure 16, delivery conduit 22 may be formed from a series of pipes or tubes threadably, adhesively, or otherwise connected together. Alternatively, the entire ball delivery device may be formed using an injection molding process. In either case, the internal passage 47 defined by delivery conduit 22 must be shaped and sized to permit a ball of a particular sport to move through the passage unobstructed. Likewise, as best shown in FIG. 3, inlet aperture 44 of ball receiving portion 38 must be sized to permit the particular type of ball to be passed through aperture 44 into enclosed delivery conduit 22. As shown in FIG. 1, ball receiving portion 38 extends upwardly from delivery conduit 22 thereby functioning to guide the ball into the delivery conduit. However, it should be apparent that inlet aperture 44 may be formed directly in the wall 23 of delivery conduit 22 without the need for ball receiving portion 38. In addition, the ball delivery device may be modified to include a wide variety of known ball feeding mechanisms which sequentially release balls into the delivery conduit automatically or as manually activated by the player.

Ball discharge portion 40 is connected to the outer end of delivery conduit 22 by a rotatable connection 48. Discharge portion 40 includes a curved section 46 for directing ball 12 through an opening 41 into an unguided delivery path b in front of player 14. The rotatable connection 48 may be in the form of a friction fit, threadable connection, or any other known rotatable connection which would permit discharge portion 40 to be rotated and held in a plurality of angular positions. The speed and trajectory of ball 12 can be then changed by rotating ball discharge portion 40 to a new delivery position as desired.

Figure 2:
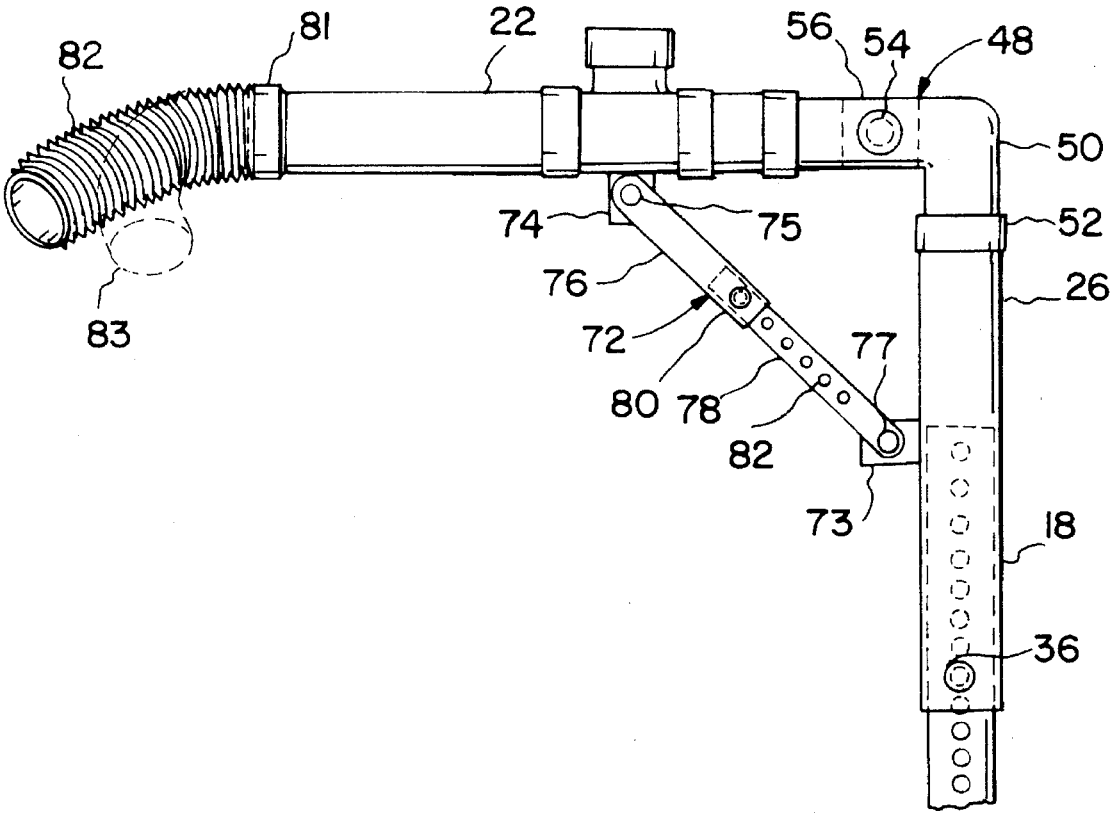
FIG. 2 is a fragmentary view of a second embodiment of the present invention showing an enclosed delivery conduit pivotally attached to a support structure and a flexible discharge portion.

FIGS. 2 and 3 disclose an alternative embodiment of the present invention. The features of this second embodiment, which are substantially the same as those in the first embodiment, are referenced using the same numerals for like components previously described in connection with the first embodiment. The enclosed delivery conduit 22 shown in FIGS. 2 and 3 is pivotally connected to upper portion 26 of column 18 by pivot joint 48. Pivot joint 48 includes a bracket 50 formed integrally with, or suitably connected to, the top end 52 of upper portion 26. The L-shaped bracket 50 includes an outwardly extending section 56 having a bolt hole 54 formed therein. Pivot joint 48 also includes two pivot plates 58, 60 formed integrally with, or suitably connected to, the top end 52 of upper portion 26. The L-shaped bracket 50 includes an outwardly extending section 56 having a bolt hole 54 formed therein. Pivot joint 48 also includes two pivot plates 58, 60 formed integrally with, or suitably attached to one end 62 of enclosed delivery conduit 22. Plates 58, 60 extend outwardly from end 62 on either side of section 56. Each plate 58, 60 contains a bolt hole 64 alignable with bolt hole 54 of section 56 such that a bolt 66 can be passed through holes 54, 64. An aperture 68, extending transversely through the small end of bolt 66, is sized to receive a pin 70 for securing bolt 66 in place. In this manner, enclosed delivery conduit 22 can be pivoted with respect to column 18 to change the delivery angle "a" thereby, changing the speed and trajectory of the ball. However, it should be noted that any other known means for pivotally connecting two elongated structures may be used to connect conduit 22 to upper portion 26.

The second embodiment shown in FIGS. 2 and 3 also includes a positioning arm 72 extending between column 18 and enclosed delivery conduit 22. A bracket 74 extends downwardly from the bottom of delivery conduit 22 while an identical bracket 73 extends outwardly from column 18. The positioning arm 72 includes two telescoping rods 76, 78. The larger rod 76 is pivotally connected to upper bracket 74 using a pin 75. In a similar manner, smaller rod 78 is pivotally connected to lower bracket 73 using pin 77. Larger rod 76 includes a spring mounted pin 80 which extends through rod 76 into one of the positioning apertures 82 formed in smaller rod 78.

The present invention is not intended to be limited to the positioning arm 72, as there are many other known means for securing two pivotally connected bodies in a desired position. For instance, the pivot joint 48 may be modified so that pivot plates 58, 60 are enlarged to include alignable positioning apertures arranged in a radial arc to permit a pin to pass through hole 54 of section 56 and the pair of positioning apertures corresponding to the desired angular position of enclosed delivery conduit 22.

FIGS. 2 and 3 also show an alternative embodiment of the ball discharge portion. The ball discharge portion 82 is formed from a flexible deformable material which permits discharge portion 82 to be repositioned by bending it into a new position 83. The discharge portion 82 may be connected to one end of the delivery conduit 22 by any appropriate connections since the discharge portion 82 need not be rotatably connected. For instance, the discharge portion 82 may be secured to the outer diameter of the end of conduit 22 by either a securable band 81, adhesive, or a threadable connection.

Pivot joint 48 and positioning arm 72 permit conduit 22 to be both replaceably and collapsibly mounted on column 18. To accommodate storage of the device, rods 76, 78 can be separated and folded to allow conduit 22 to pivot into a collapsed position substantially parallel to column 18. Also, removable bolt 66 of pivot joint 48 and spring mounted pin 80 permit conduit 22 to be completely removed from column 18. In this manner, conduit 22 can be replaced with a conduit having a different shape or size, for example, corresponding to a larger sized ball.

In operation, the ball delivery device 10 may be placed in any open area where balls could be hit without damaging the surroundings, for instance an open field or in a gym with a net positioned on one side of the device to catch the balls. The support structure is adjusted to the appropriate height corresponding to the height of the player by pulling spring mounted pin 36 and raising or lowering upper portion 26 until the desired height is achieved. The pin 36 is then released to secure the delivery conduit 22 and portion 26 in place. A ball 12 is then passed through inlet aperture 44 of ball receiving portion 38. The ball 12 moves by gravity through the enclosed non-transparent delivery conduit 22 toward the ball discharge portion 40. The player is unable to see the movement of the ball through conduit 22 until the ball exits portion 40 via opening 41. The player or batter must then quickly swing his racket or bat while utilizing his eye to hand coordination skills.

Since the batter knows the approximate discharge path of the ball based on the stationary opening 41, he can position himself at a proper hitting distance from the path to compel himself to properly extend his arms. Also, the batter is forced to increase his bat speed and utilize the proper wrist action in order to get his bat around in time to hit the ball.

Ball discharge portion 40 may be rotated to vary the speed and trajectory of the ball. For example, if the ball discharge portion is rotated so that opening 41 is directed more downwardly, the ball will exit at a higher speed creating a more difficult pitch to hit. Alternatively, discharge portion 40 may be rotated upwardly to slow down the exit of ball 12 making the ball easier to hit. Likewise, ball discharge portion 82 shown in FIGS. 2 and 3 may be bent to direct the ball into a variety of discharge paths. Therefore, ball discharge portions 40, 82 can be rotated or bent, respectively, to change the degree of difficulty desired by the batter by changing the speed and trajectory of the ball.

The ball delivery device shown in FIGS. 2 and 3 permit the batter, or his assistant, to change the delivery angle of the ball by repositioning the arm 72. Spring mounted pin 80 is pulled and rods 76, 78 moved relative to each other until the desired angle is achieved and secured by releasing pin 80. By changing the delivery angle of conduit 22, the positioning arm 72 permits the user to change the effect of gravity on ball 12 as it passes through conduit 22 thereby affecting the ultimate discharge speed of the ball and the difficulty of the pitch. Of course, the greater the delivery angle the greater the discharge speed of the ball assuming the discharge portion 40 is in the same position. Therefore, it can be seen that positioning arm 72 and ball discharge portions 40, 82 can be used in combination to provide an infinite number of different ball delivery paths or pitches having unique speeds and trajectories.

Figure 4:
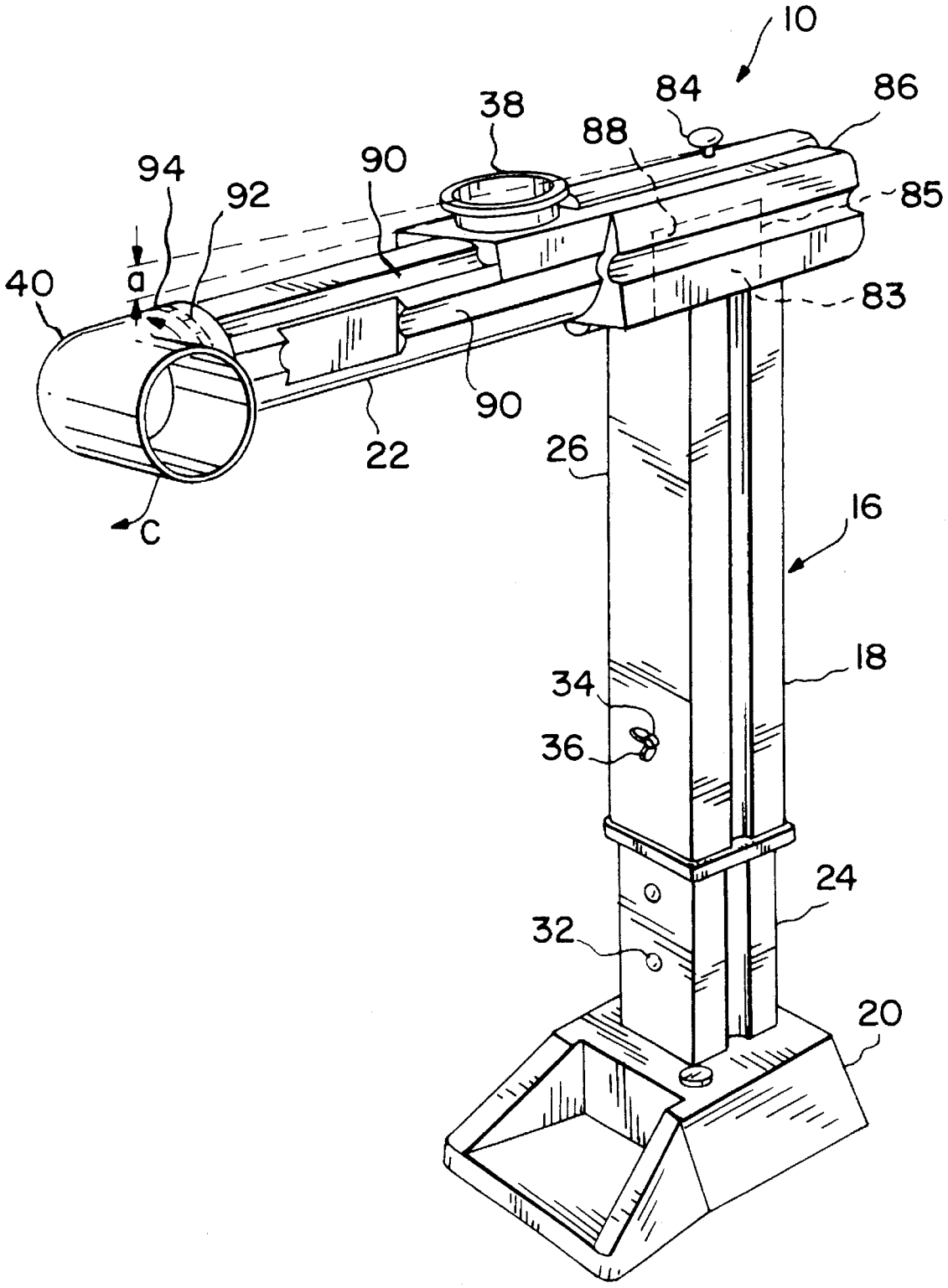
FIG. 4 is a perspective view of a third embodiment of the present invention.
Figure 5:
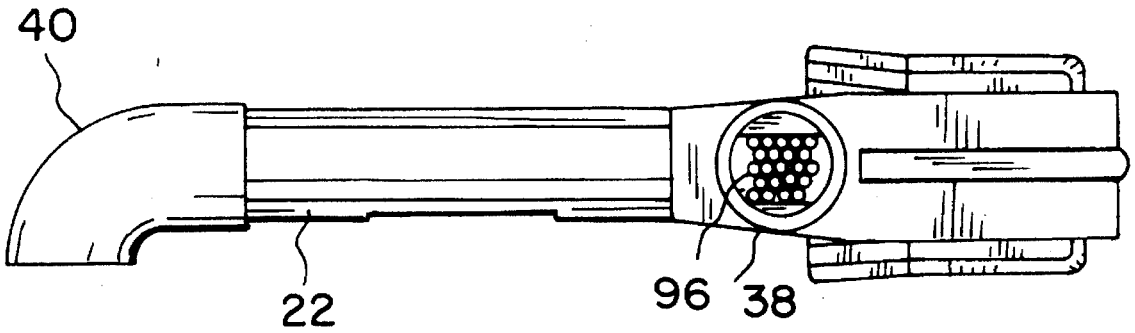
FIG. 5 is a top view of the third embodiment of the present invention.

FIGS. 4 and 5 illustrate a third embodiment of the present invention. Specifically, with reference to FIG. 4, ball delivery device 10 is shown with non-transparent delivery conduit 22. In this embodiment, delivery conduit 22 is not connected to vertical column 18 in such a way to permit relative movement therebetween. Instead, delivery conduit 22 is fixedly connected to vertical column 18 to maintain a constant angle "a". The delivery conduit may be connected to column 18 in any conventional manner so as to maintain the angle "a". Ideally, column 18 may include an upper portion 83 which is dimensionally smaller than the remainder of column 18, but which is square or rectangular in cross-section. This upper portion may be insertable into a complementary square or rectangular recessed portion 85 formed in delivery conduit 22 to provide a secure point of attachment while not obstructing the path within delivery conduit 22 through which the ball travels during use. A threaded fastener 84 may be used to further secure delivery conduit 22 to column 18. The bottom wall 86 of the recessed portion 85 may be angled to engage an angled end wall 88 of the upper portion 83 to further maintain the angle "a". The complementary cross sectional shapes of the upper portion 83 of the vertical column 18 and the recessed portion 85 of delivery conduit 22 prevent the delivery conduit from rotating relative to the delivery conduit. Alternatively, delivery conduit 22 may be threadingly engaged with a complementary threaded portion of column 18 (not shown).

Delivery conduit 22 may also include indents 90 which run substantially the entire length thereof. Indents 90 add additional stability and rigidity to delivery conduit 22. The bottom of delivery conduit 22, however, is arcuate up to the side indents 90. This provides a complementary surface on which the ball may travel down the delivery conduit. Indents 90 running along the side of delivery conduit 22 also guide the ball as it travels down the delivery conduit by limiting the side to side movement of the ball.

As also provided by the embodiment shown in FIG. 1, discharge portion 40 is designed to be rotatably attached to delivery conduit 22. Specifically, discharge portion 40 is designed to be rotated in the direction "c" between an angular range of 90° and 180° with respect to the central axis of column 18, which is positioned at 0° to 180° or vertical, depending upon whether the batter is left or right handed for a total angular range of 90° to 270°. FIG. 4 shows the device in position for a right handed batter. By varying discharge portion 40 between 90° and 180° for a particular handed batter, ball delivery device 10 is capable of propelling the ball in a direction which simulates actual play, in that, the ball is directed to the batter in the direction a pitch would be thrown from a pitcher, while also permitting an increase or decrease in the degree of difficulty of the pitch. In this way, unlike prior devices, speed is not used as means for achieving a higher degree of difficulty. Difficulty settings of the present invention are a direct function of the concealment of the ball until it is delivered.

The end of delivery conduit 22 is round and complements the shape of discharge portion 40. Therefore, indents 90 terminate prior to the end of delivery conduit 22. The round end of delivery conduit 22 permits rotation of the discharge portion relative to the delivery conduit. In addition, discharge portion 40 may include an inwardly directed notch 92 which engages a groove 94 in delivery conduit 22. Specifically, groove 94 extends around the surface of the delivery conduit at the end thereof to create a track-like portion for notch 92 to travel to further enhance the rotatable nature of discharge portion 40 and secure discharge portion 40 to the end of delivery conduit 22. Groove 94 is preferably designed to terminate at approximately 90° and 270° position on the delivery conduit. In other words, groove 94 preferably extends frown approximately 270° to 360° and 0° to approximately 90°. Indicia may also be included on the surface of delivery conduit 22 adjacent discharge portion 40 to provide a visual indication of the varying levels of difficulty provided by the particular position discharge portion 40 is in.

Such an angular adjustment ability permits ball delivery device 10 to be positioned to the side of the batter while still delivering the ball from the direction the ball would travel during actual play. As a result, there is no danger of the player or of the unit being hit by the ball. Many prior devices delivered the ball from the side which does not simulate an actual pitch accurately and also may cause the ball to hit the batter. Further, if such a device is positioned in front of the batter to simulate an actual pitch, both the unit and the person feeding the balls may be in danger of being hit.

Further, in the embodiment illustrated in FIG. 4, angle "a" is preferably just large enough to cause a ball dropped through ball receiving portion 38 to travel as a result of gravity through delivery conduit 22. By maintaining angle "a" relatively small, a ball dropped through ball receiving portion 38 tends to hesitate in delivery conduit 22 for an unpredictable amount of time before it begins to move. Angle "a" is preferably within the range of 1° to 10°, but more preferably within the range of 3 ° to 5°.

This limited angular feature further prevents a user from anticipating or timing when the ball should exit through discharge portion 40 because each time the ball is dropped a slightly different discharge time will result. For example, during one drop, the ball may land on the stitching causing the ball to react one way, while on another drop, the ball may land on the smooth leather causing a different reaction. As a result, the ball will generally never exit the unit at quite the same speed. This further enhances the user's batting skills, such as eye to hand coordination.

In addition, below ball receiving portion 38, delivery conduit 22 may include members which create further hesitation of the ball within the delivery conduit before it begins movement or as it travels therethrough. The members may extend down the entire length of delivery conduit 22, at least on the the arcuate bottom portion thereof delivery conduit 22, or any other desired extent. For instance, with reference to FIG. 5, a plurality of raised portions 96 are provided within delivery conduit 22 to provide additional variation to the time it takes a ball passed through delivery conduit 22 to exit through discharge portion 40. It should be understood that any other type of design variations could be made within delivery conduit 22 to alter the speed at which the ball exits the device.

The present invention permits a batter to incrementally improve his batting skills by gradually increasing the degree of difficulty of each pitch as his skills are improved. Once the batter has proven that he can consistently hit a certain pitch, the speed and trajectory of the ball can be modified to increase the difficulty of the pitch. In this manner, the ball delivery device allows the player to sharpen such batting skills as eye to hand coordination, bat speed, arm extension and wrist action. In addition, since the delivery tube is enclosed and non-transparent, the player is unable to anticipate the pitch. A common problem with baseball or softball batters is the tendency to drop their rear shoulder in anticipation of the pitch. By preventing the batter from anticipating the discharge of the ball, the present invention greatly decreases the tendency of the batter to develop the habit of dropping his shoulder prior to swinging.

It should be noted that the present invention is not intended to be limited to the sport of baseball. The ball delivery device of the present invention could be used to improve the hitting skills of players of various sports such as softball, tennis and racquetball.

I claim:

1. A ball delivery device for delivering a ball to a player comprising:

a substantially vertical support structure;

an elongate enclosed delivery conduit extending outwardly from said support structure, said delivery conduit including a ball discharging means positioned at one end of said delivery conduit for singularly discharging a ball from said delivery conduit into an unguided delivery path and a ball receiving means spaced from said discharging means including an inlet aperture extending upwardly from said enclosed delivery conduit for permitting a ball to be positioned in said delivery conduit, said delivery conduit being sufficiently nontransparent to prevent a player from viewing a ball traveling through said delivery conduit until the ball is discharged from said discharging means into the unguided delivery path wherein said enclosed conduit extends outwardly from said support structure at a sufficient delivery angle to cause a ball positioned therein to move by gravity away from said support structure, said ball discharging means including a curved discharge section terminating in a discharge opening of sufficient size to permit passage of a ball therethrough wherein said curved discharge section is connected to said delivery conduit to permit rotation of said curved discharge section, said delivery conduit including hesitation members positioned directly below said inlet aperture on the bottom portion of said delivery conduit to engage a portion of a ball placed therein to vary discharge time of the ball.

2. The device of claim 1, wherein said delivery conduit is positioned at an angle of 80° to 89° with respect to said support structure.

3. The device of claim 2, wherein said delivery conduit is positioned at an angle of 85° to 87° with respect to said support structure.

4. The device of claim 1, further including a base structure attached to one end of said vertical support structure and a height adjusting means for adjusting the vertical distance between said base structure and said enclosed delivery conduit.

5. The ball delivery device of claim 1, wherein said hesitation members comprise a plurality of raised portions positioned directly below the inlet aperture on the bottom portion of said delivery conduit.

* * * * *